US007140498B2

(12) United States Patent
Pippin et al.

(10) Patent No.: US 7,140,498 B2
(45) Date of Patent: Nov. 28, 2006

(54) MAIL DELIVERY SYSTEM

(75) Inventors: James M. Pippin, Keller, TX (US); Gerald A. Isaacs, Arlington, TX (US); Floyd W. Worth, II, Richardson, TX (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/788,598

(22) Filed: Feb. 27, 2004

(65) Prior Publication Data

US 2004/0168993 A1 Sep. 2, 2004

Related U.S. Application Data

(62) Division of application No. 09/924,155, filed on Nov. 26, 2001, now Pat. No. 6,715,614.

(51) Int. Cl.
*B42F 17/00* (2006.01)

(52) U.S. Cl. ..... 211/12; 211/46; 211/85.15; 211/189

(58) Field of Classification Search ..... 211/10, 211/11, 12, 45, 46, 85.15, 201, 189, 195; 248/95, 99–101; 312/183, 184, 50, 117, 312/128; 383/37, 119, 34; 209/702, 703, 209/630, 942, 900
See application file for complete search history.

(56) References Cited

U.S. PATENT DOCUMENTS

| | | | | | |
|---|---|---|---|---|---|
| 254,836 | A | | 3/1882 | Nauerth | |
| 660,541 | A | * | 10/1900 | Field | 211/11 |
| 779,551 | A | * | 1/1905 | Letts | 211/133.1 |
| 802,320 | A | * | 10/1905 | Rice | 248/97 |
| 862,243 | A | * | 8/1907 | Field | 211/12 |
| 928,106 | A | * | 7/1909 | Carpenter | 383/34 |
| 1,205,213 | A | * | 11/1916 | Johnson | 248/99 |
| 1,418,403 | A | * | 6/1922 | Smith | 383/38 |
| 1,640,083 | A | * | 8/1927 | Ladd | 211/186 |
| 1,755,950 | A | * | 4/1930 | Dobson et al. | 248/97 |
| 2,623,527 | A | * | 12/1952 | Guichard | 211/126.13 |
| 2,625,973 | A | * | 1/1953 | Weldon et al. | 206/459.5 |
| 2,759,612 | A | * | 8/1956 | Brinkmann | 211/46 |
| 3,167,074 | A | | 1/1965 | Toms | 129/16 |
| 3,732,978 | A | | 5/1973 | Reader | 209/122 |
| 3,760,943 | A | * | 9/1973 | Reader | 209/546 |
| 4,168,004 | A | | 9/1979 | Owen | 209/545 |
| 4,219,247 | A | * | 8/1980 | Litchfield et al. | 312/184 |
| 4,249,663 | A | * | 2/1981 | Hewlett | 209/705 |
| 4,429,789 | A | * | 2/1984 | Puckett, Jr. | 206/370 |
| 4,493,684 | A | | 1/1985 | Bolton | 493/234 |
| 4,527,694 | A | * | 7/1985 | Bolt et al. | 211/46 |
| 4,589,555 | A | | 5/1986 | Hollingsworth | 209/703 |
| 4,593,816 | A | | 6/1986 | Langenbeck | 206/425 |
| 4,720,048 | A | * | 1/1988 | Maroney et al. | 280/47.34 |
| 4,756,657 | A | | 7/1988 | Kinney | 414/281 |
| 4,765,490 | A | * | 8/1988 | Hanson | 211/46 |
| 4,789,248 | A | | 12/1988 | Penas | 383/38 |

(Continued)

FOREIGN PATENT DOCUMENTS

| | | |
|---|---|---|
| CH | 1450890 | 1/1989 |

(Continued)

*Primary Examiner*—Jennifer E. Novosad

(57) ABSTRACT

A mail case system facilitates sequence-sorting various types of mail together into individual bags that each represent delivery points. The mail case uses multi-bag inserts so that bags for a number of stops can be set up for sorting. At the end of the sorting operation, the entire insert may be pulled down from the case as a single unit to maintain the established delivery point sequence.

10 Claims, 16 Drawing Sheets

U.S. PATENT DOCUMENTS

| | | | | | |
|---|---|---|---|---|---|
| 4,802,773 | A | | 2/1989 | Gross | 383/16 |
| 4,836,428 | A | | 6/1989 | Evans et al. | 224/253 |
| 4,880,121 | A | | 11/1989 | D'Elia | 209/702 |
| 4,979,705 | A | | 12/1990 | Bovitz | 248/97 |
| 5,000,325 | A | | 3/1991 | D'Elia | 209/702 |
| 5,024,344 | A | * | 6/1991 | Paula | 220/9.3 |
| 5,025,979 | A | * | 6/1991 | Dellacroce | 229/67.2 |
| 5,035,515 | A | | 7/1991 | Crossman et al. | 383/38 |
| 5,086,934 | A | * | 2/1992 | Kelly | 211/45 |
| 5,109,252 | A | * | 4/1992 | Schott, Jr. | 399/83 |
| 5,119,942 | A | * | 6/1992 | McCullars | 211/10 |
| 5,190,252 | A | | 3/1993 | Schrager | 248/97 |
| 5,211,290 | A | * | 5/1993 | Janus et al. | 206/583 |
| 5,234,116 | A | * | 8/1993 | Kristinsson et al. | 211/201 |
| 5,238,139 | A | * | 8/1993 | Bisceglia | 220/495.09 |
| 5,590,794 | A | | 1/1997 | Zachary | 209/702 |
| 5,725,119 | A | * | 3/1998 | Bradford et al. | 220/6 |
| 5,804,265 | A | | 9/1998 | Saad et al. | 428/35.2 |
| 5,815,903 | A | * | 10/1998 | Foster et al. | 29/401.1 |
| 5,836,488 | A | | 11/1998 | Priestley | 224/222 |
| 5,845,826 | A | | 12/1998 | Nguyen | 224/222 |
| 5,885,002 | A | * | 3/1999 | Reiss | 383/37 |
| 5,931,304 | A | | 8/1999 | Hammond | 206/570 |
| 6,464,092 | B1 | * | 10/2002 | Kortman et al. | 211/194 |
| 6,648,153 | B1 | * | 11/2003 | Holmes | 211/85.15 |
| 6,715,614 | B1 | * | 4/2004 | Pippin et al. | 209/702 |
| 6,830,156 | B1 | * | 12/2004 | MacKelvie | 211/40 |
| 2004/0007544 | A1 | * | 1/2004 | MacKelvie | 211/40 |
| 2004/0099622 | A1 | * | 5/2004 | Lee | 211/85 |

FOREIGN PATENT DOCUMENTS

| | | |
|---|---|---|
| EP | 0 949 015 A2 | 10/1999 |
| WO | WO 95/33580 | 12/1995 |

* cited by examiner

FIG. 1
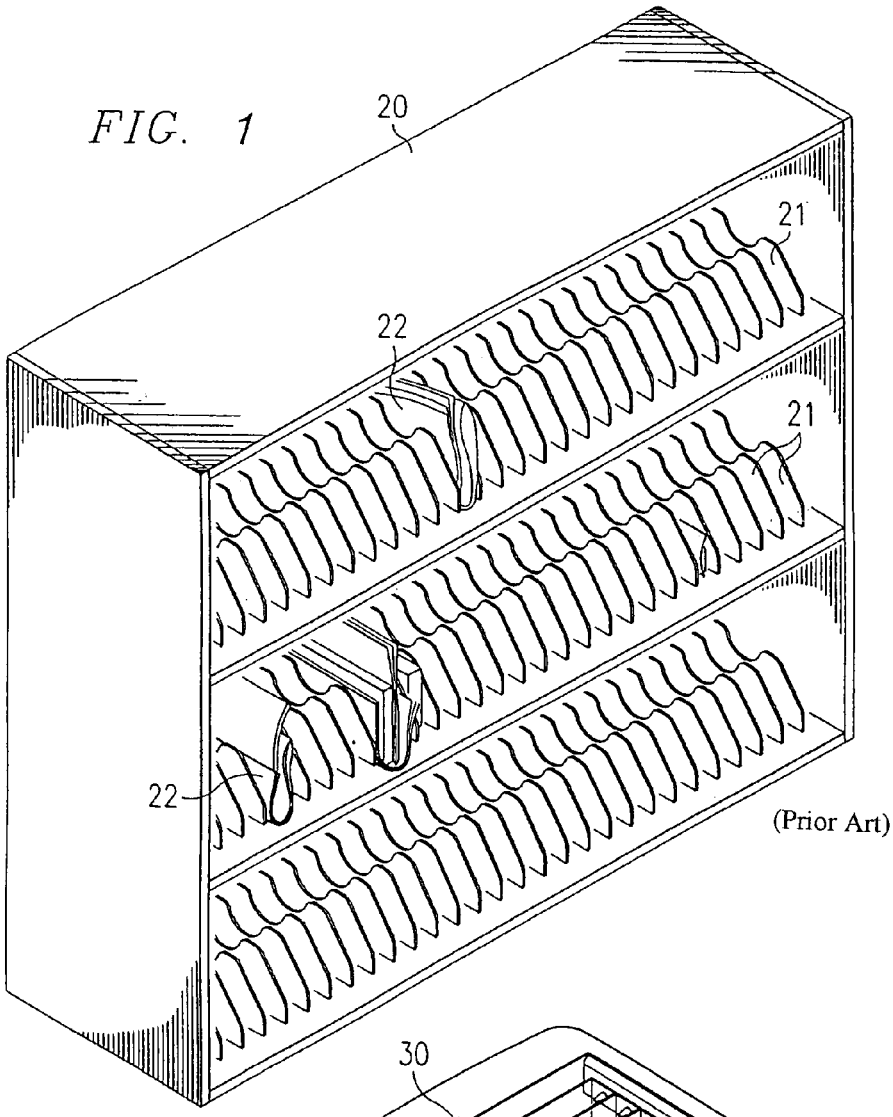
(Prior Art)
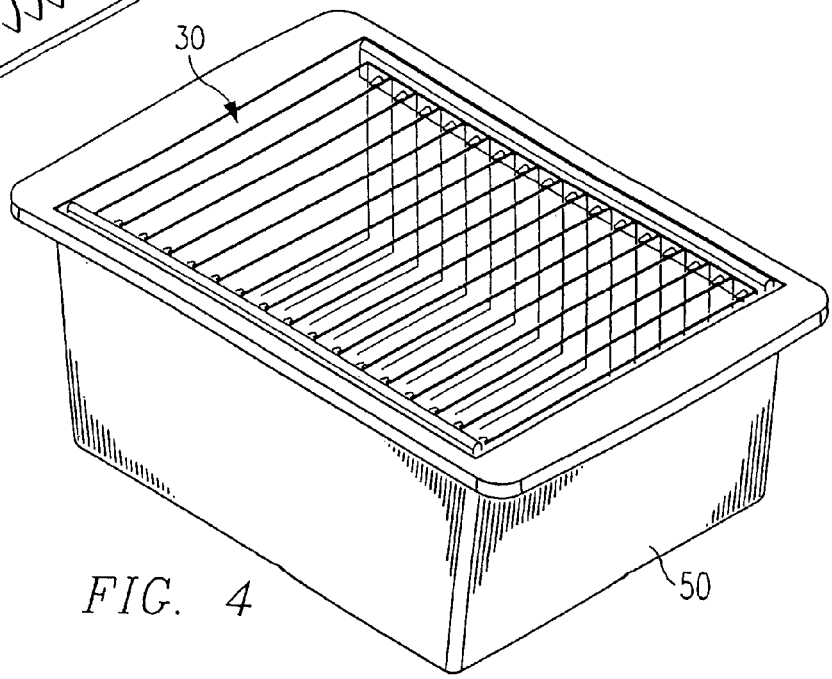
FIG. 4

FIG. 11
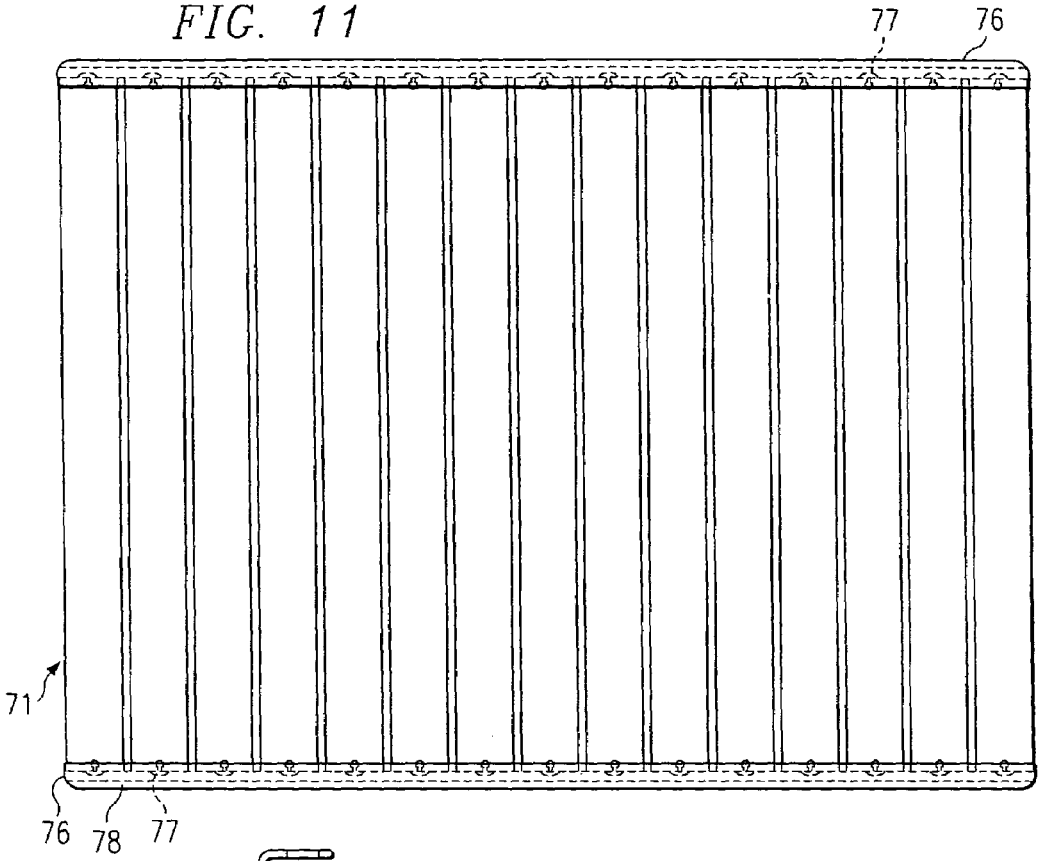
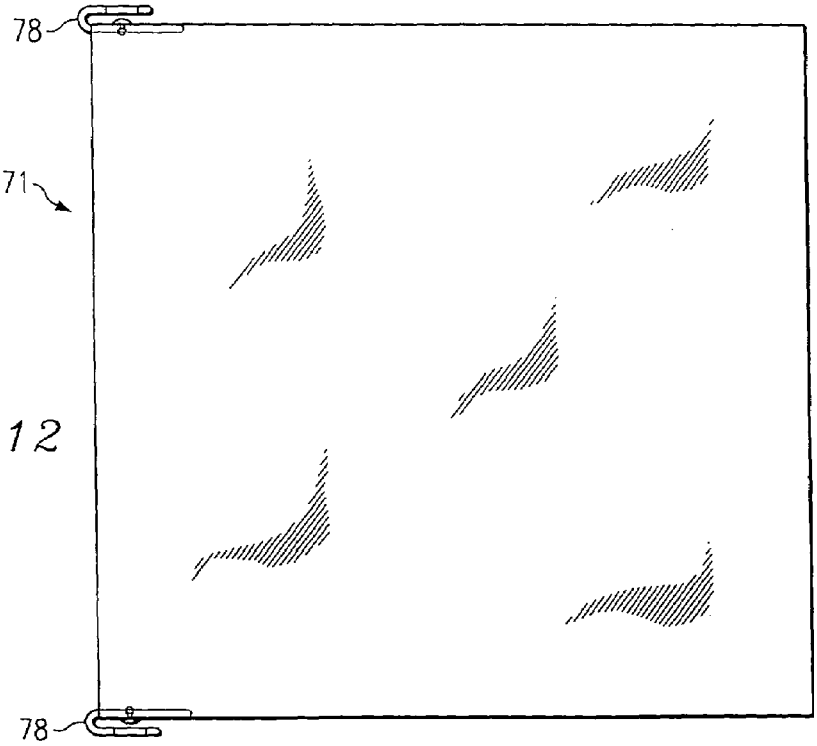
FIG. 12

MAIL DELIVERY SYSTEM

This application is a divisional of U.S. patent application Ser. No.: 09/924,155, filed Nov. 26, 2001, now U.S. Pat. No. 6,715,614.

BACKGROUND OF THE INVENTION

Each day more than 200,000 United States Postal Service (USPS) carriers deliver mail to approximately 100 million individual domestic addresses. Mail generally consists of three broad types of items, namely letters, flat mail that is larger than letter mail, and parcels. Before a carrier begins to walk through or drive through his or her delivery route, it is the carrier's responsibility to put all of this mail into an appropriate sequence for efficient delivery.

Under the present USPS procedure, the carrier assembles at least three sequenced stacks of mail, including letters, flats (including enveloped and non-enveloped magazines), and parcels. The carrier may also have one or more additional sequenced stacks, e.g., pre-sorted mass-mail items to be delivered to many or all of the stops on the delivery route. Thus, at each delivery stop the carrier selects the items for that address from each of the various stacks and puts them all into the postal patron's mailbox. This sorting and shuffling through various stacks of mail is time consuming, inefficient, and consequently expensive to the USPS.

Preliminary tests by the USPS indicate significant potential savings in carrier delivery time if all of the mail pieces for each stop are consolidated into a single package before the carrier begins delivery activities. However, with current mail sorting procedures and the mail-casing equipment now available to the carriers, the additional time required for the carrier to pre-consolidate the mail into individual packages essentially negates the potential savings in delivery time.

More efficient procedures and equipment can be deployed within the post office to make the operation more efficient, thus saving substantial amounts of time and money, by making use of a different sorting system and method as described herein. The current mail case into which the carrier pre-sequences the mail is shown in FIG. 1 as mail case 20. Mail case 20 is not ergonomically well designed to accommodate letters and flats together, nor highly suitable to facilitate expeditious containerizing most or all of each patron's mail for efficient delivery.

Two significant problems have been observed. Dividers 21 between stops in existing USPS mail cases are relatively rigid, and they cannot conveniently be repositioned during a sort. If a particular patron gets an excessive amount of mail on a given day, the carrier removes part or all of it temporarily. The carrier then must reconsolidate that patron's mail at the end of the casing operation. Also, as the slot fills, it becomes increasingly difficult to case additional mail into that slot. A more flexible partition between slots would help to remedy both of these shortcomings.

The slots are generally too small to accommodate flats without folding them over as shown in FIG. 1 (folded flat 22). This folding operation is time-consuming and thus costly, and it tends to fill the slot prematurely. In some cases the mail cannot be folded without incurring damage. In this case it must be handled separately, incurring additional handling time and associated labor cost. Larger slots eliminate some of this additional handling effort, but wastes space.

For efficient delivery, all of the mail for each postal patron should be individually containerized or wrapped. To accomplish this with the existing case 20, the contents from each slot must be removed and packaged one stop at a time. With the existing USPS case design, the time required to package each patron's mail stop-by-stop exceeds the resulting time savings along the delivery route.

The USPS has attempted a system wherein a grocery store-style frame holds a horizontal stack of plastic bags. One bag is torn off the pad and made ready for filling by stretching it open on the frame, while the remaining bags remain on the pad in a closed or completely collapsed (flat) condition. In pulling down the mail from the slots in the case, the postal carrier takes mail from one slot, puts it in a bag, removes the bag from the frame and puts it in a flats tub or letter tray, generally in delivery order. This exposes the next bag on the frame for the mail in the next case slot corresponding to a delivery address. This process makes use of bags to keep mail for a single destination together, but requires several steps and is thus labor intensive. The pull-down process is carried out one destination at a time.

SUMMARY OF THE INVENTION

A newly designed mail case is hereby proposed. It facilitates sequence-sorting various types of mail together into individual bags that each represent unique delivery points. The mail case uses multi-bag inserts so that the bags for several stops can be set up quickly for sorting. At the end of the sorting operation, the entire insert or a portion of it may be pulled down from the case as a single unit to maintain the established delivery point sequence. This eliminates the carrier's need to find separation points or to combine selections from multiple sequenced stacks of mail during the subsequent delivery operation. This results in a dramatic improvement in delivery efficiency. Flexible bag walls allow mail to randomly overfill mail slots that receive greater than the standard volume of mail. This overfilling feature improves efficiency while maintaining slot density.

The invention also provides a more efficient method for sorting a batch of mail to a set of addresses. Such a method includes the steps of: (a) determining the destination address of a mail piece, such as by human review or machine scanning; (b) placing the mail piece in a flexible-walled bag that is one of a row of bags associated with the set of addresses; and (c) repeating steps (a) and (b) until all or substantially all mail in the batch for which an address can be determined has been placed within a bag. In a preferred embodiment, the mail pieces are letters, flats, or parcels, and the bags are accordingly configured as rectangular thin-walled bags, preferably of plastic, with elongated, straight mouths disposed side-by-side to form a rectangular group of bags, or a multi-bag. Following steps (a)–(c), the invention preferably further includes steps of (d) removing groups of bags simultaneously from the rack for placement in a carrying container such as a postal tub or delivery satchel, and then disconnecting the bags for quick and efficient delivery. In this manner, the invention provides for simultaneous bagging and sorting of flat mail, and optionally further permits a group of bags to be pulled-down from the sorting case in order, instead of one address at a time pull-down as presently practiced by the U.S. Postal Service.

A storage device for use in such a method preferably includes a series of flexible, thin-walled bags disposed side by side such that mouths of the bags face a common direction and form a row. The side edges of the mouth of each bag may be integrally bonded (as by fusing or adhesive) to the edges of the mouths of adjoining bags in the widthwise direction of the device to prevent inadvertent insertion of mail between adjacent bags. However, when a case provided with a bag tensioning mechanism is employed, the tension applied to the bags is often sufficient to prevent this, and the bag mouths need not be bonded. The bags are also preferably united by at least one, preferably two reinforcing strips extending in the lengthwise direction of the device. The strips may be formed integrally as part of the multi-bag, or may have suitable means for mounting the series of bags thereon. Preferably a pair of the reinforcing strips are disposed along the top corners of the device on either side of the row of the mouths of the bags. These strips in combination with the means for mounting the bags to the strips should have sufficient strength so that the multi-bag can be manually handled without causing individual bags to separate, yet permit separation of individual bags at the appropriate time, as described hereafter. The strips may also have means thereon for removably securing the storage device to a supporting frame so that the mouths of the bags remain open as items are placed into the bags through the mouths, the strips acting to facilitate loading of the bags into the case.

The storage device of this invention may optionally provide perforations near the mouth of each bag allowing the bag to be torn off. In such a case, the postal carrier can use the storage device directly as a delivery device, replacing the traditional postal satchel into which loose or rubber-banded bundles of mail are placed. To deliver mail, the carrier carries the device, assisted if needed by handles or a strap provided for that purpose. To deliver mail, the carrier walks or drives his or her route and tears off one bag per delivery address, greatly speeding the delivery process.

According to a preferred form of the invention, the multi-bag comprises a series of flexible walled bags disposed side by side such that mouths of the bags face a common direction and form a row, giving the multi-bag a generally rectangular shape when unfilled and stretched to a taut condition. Side edges of each bag near the mouth of each bag may be integrally bonded to the edges of the mouths of adjoining bags. A pair of reinforcing strips extending in the lengthwise direction of the multi-bag along opposite upper corners of the multi-bag. Suitable means are provided for attaching the strips to the multi-bag so that the strips unite the multi-bag, and the strips and attaching means may have sufficient strength so that the multi-bag can be handled without coming apart, especially when loaded, for example, with up to about 20 pounds of mail pieces or other items. The attaching means may take a variety of forms as described hereafter including applied adhesive, adhesive tape double or single sided, weld(s), mechanical interlocking of bag surfaces, and fasteners.

A preferred sorting case of the invention suitable for use with such multi-bag storage devices has suitable means for mounting the storage devices therein with the bag mouths facing outwardly, means for tensioning the bags to hold the bag mouths open during loading of items therein and for relaxing the bags to facilitate mounting in and removal from the case, and means for locking the bags in a taut condition during loading. The locking mechanism according to this embodiment preferably includes a movable shelf that moves relative to a stationary shelf to pull the bags taut from opposite sides, and a mechanism for releasably clamping opposite sides of each multi-bag to lock them into position during loading, so that the bags do not work loose from the case during mail sorting.

As discussed above, a postal sorting case includes a plurality of slots defined by dividing walls, each slot being labeled for sorting of mail to a specific address. Regardless of the specific construction of the sorting case, an essential principle of the invention is the use of slot dividing walls made of a flexible or compliant material which permits random overfilling of certain slots while maintaining the same overall slot density. This could be accomplished using, for example, flexible pouches or bendable dividers, without the multi-bag features. These and other aspects of the invention are described in the detailed description that follows.

BRIEF DESCRIPTION OF THE DRAWINGS

In the accompanying drawings:

FIG. 1 is a perspective view of a prior art sorting case now in use at the USPS;

FIG. 4 is a perspective view of the multi-bag storage device of FIG. 2 inserted in a postal tub;

FIG. 11 is a top view of the alternative multi-bag device shown in FIG. 9;

FIG. 12 is a side view of the device of FIG. 11;

DETAILED DESCRIPTION

One implementation of the invention incorporates a multi-bag mail-case insert whereby the carrier cases the mail directly into individual bags that are then delivered to respective postal patrons. The multi-bag mail-case insert has several advantages: fast mail-case set-up in preparation for mail sorting, fast pull-down from the sorting case or rack after the casing operation is completed, flexible slots to accommodate variations in mail volume for individual mail patrons on a given day, and convenient maintenance of sequence order for efficient delivery.

Figure 2:
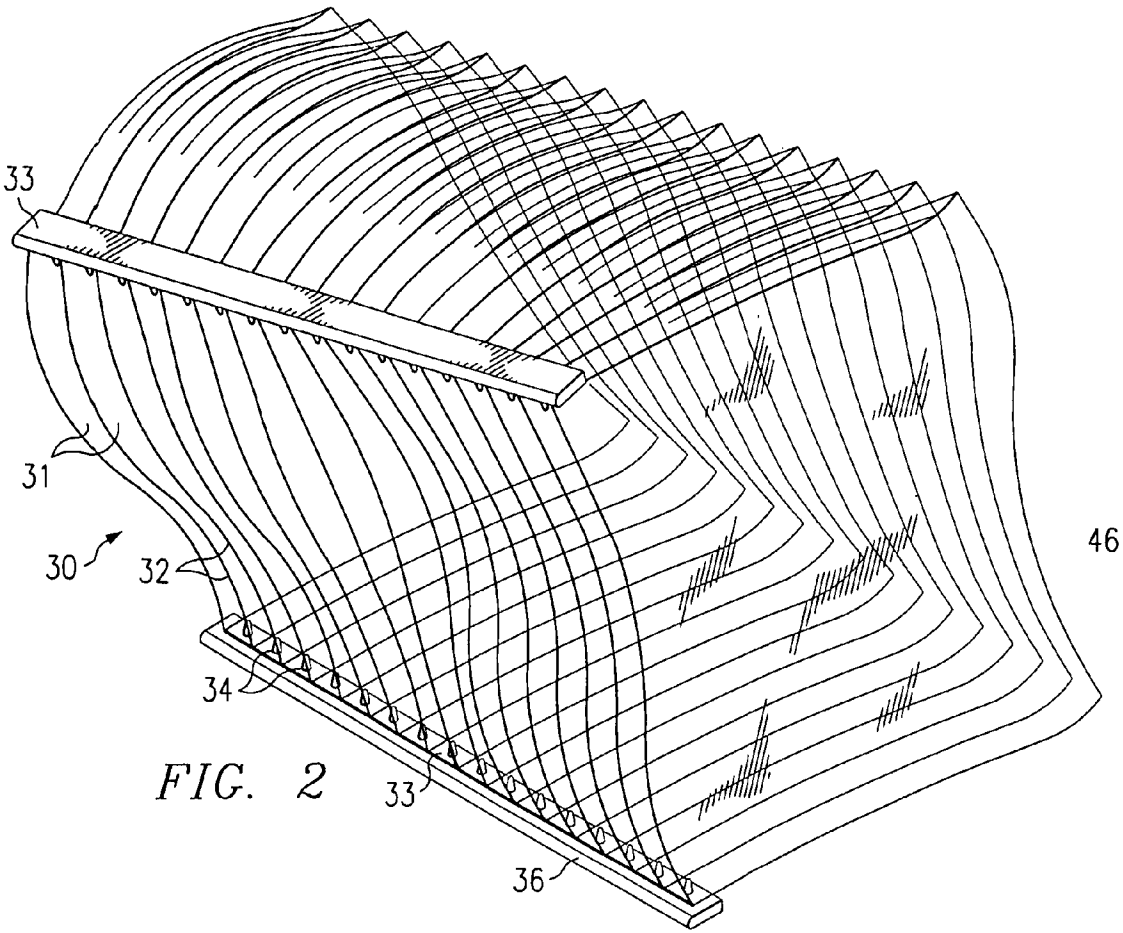
FIG. 2 is a perspective view of a multi-bag storage device according to the invention.
Figure 5:
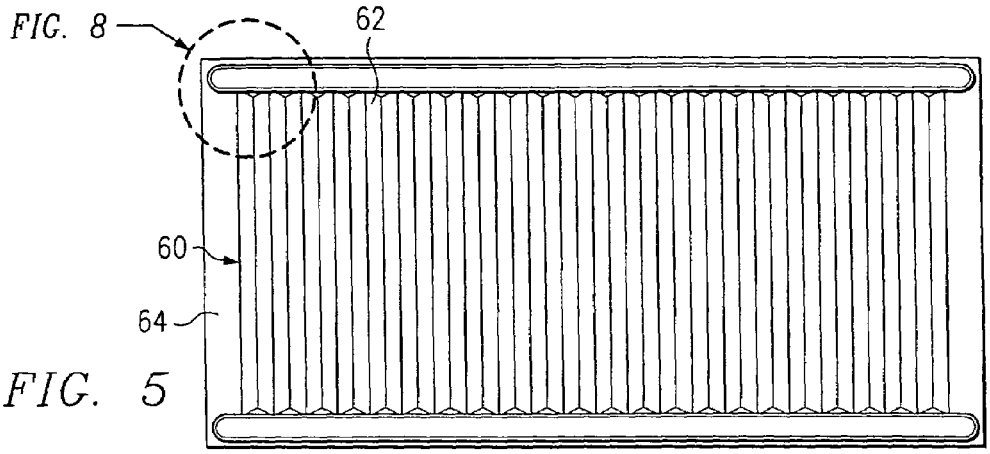
FIG. 5 is a top view of an alternative multi-bag device according to the invention mounted on a frame.
Figure 6:
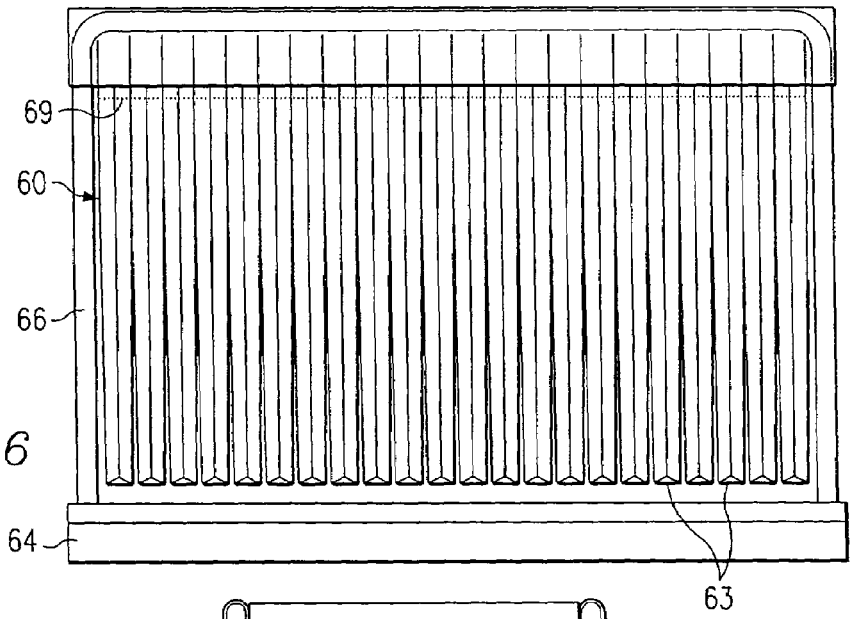
FIG. 6 is a side view of the device and frame of FIG. 5.
Figure 7:
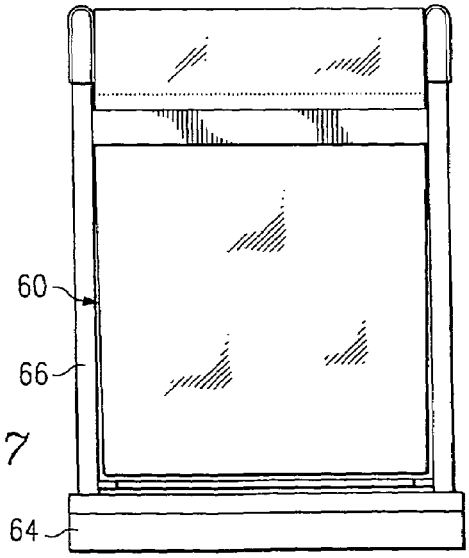
FIG. 7 is an end view of the device and frame of FIG. 5.
Figure 9:
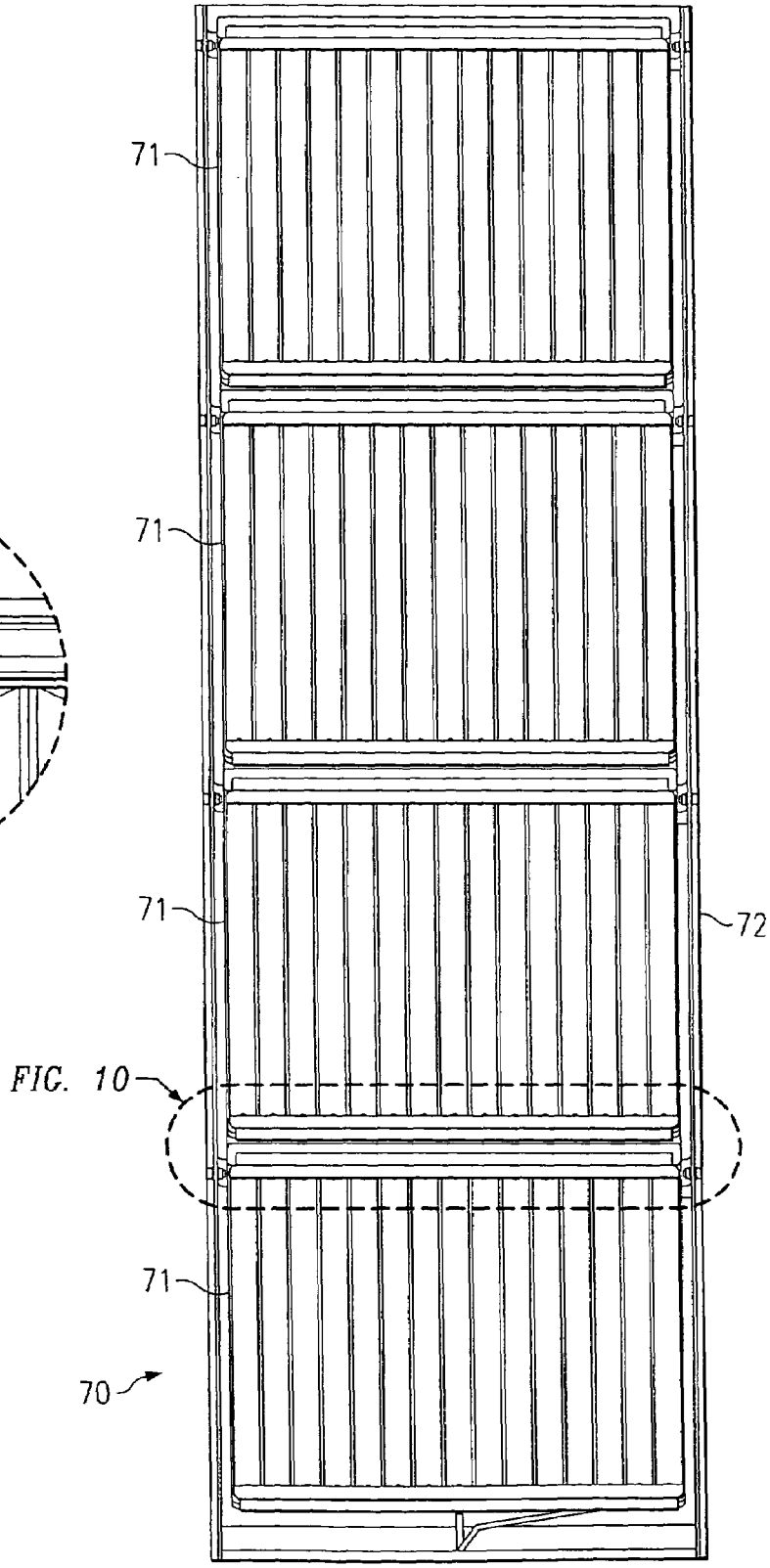
FIG. 9 is a front view of a first mail sorting case according to the invention.
Figure 8:
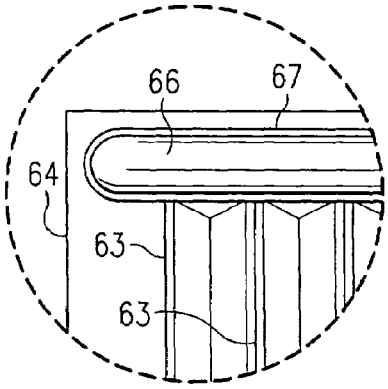
FIG. 8 is an enlarged view of the upper left corner of FIG. 5.
Figure 10:
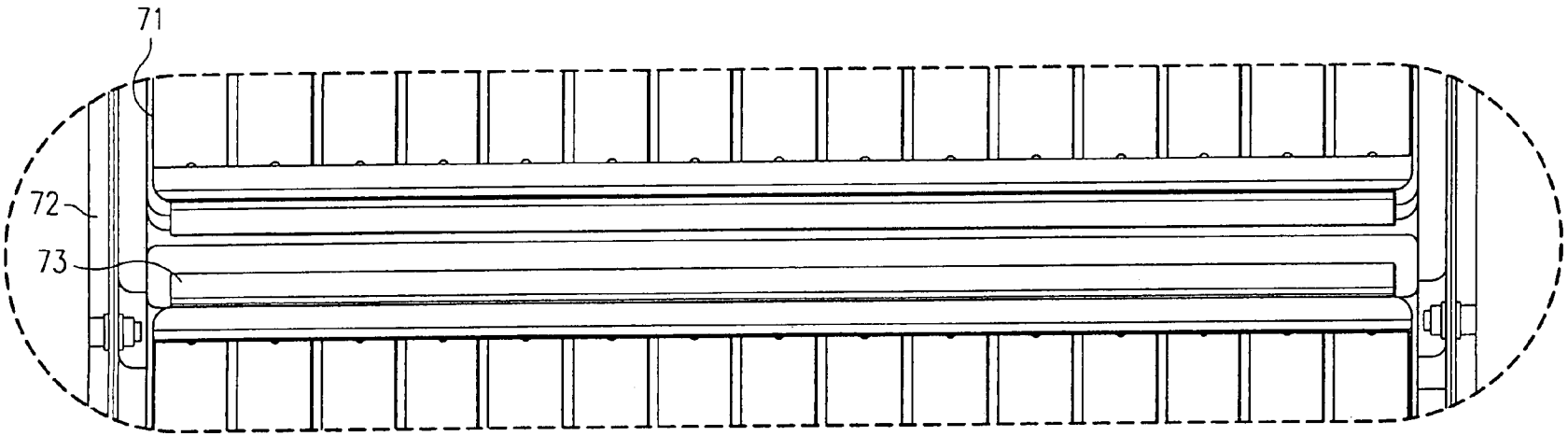
FIG. 10 is an enlarged view of the circled area in FIG. 9.

A sample multi-bag storage device 30 according to the invention as shown in FIG. 2 includes a series of thin-walled high-density polyethylene (HDPE) bags sized to receive a flat (at least 8.5 by 11, or magazine size) to be received through the open side or mouth 31 of each bag without folding. From the standpoint of recycling economy, the multi-bag 30 is preferably as thin as its purpose permits, such as from about 1 or 2 mils, especially 1–2 mils in thickness. Each bag may be integrally bonded (fused or adhesively secured) to each adjoining bag along the margin 32 near the mouth of each bag in the widthwise direction. For purposes of the invention, the widthwise direction of the multi-bag extends laterally from one end of each bag mouth to the other, whereas the lengthwise direction runs perpendicular thereto and generally represents the longest dimension of the multi-bag, which is usually rectangular (in geometrical terms, in the shape of a rectangular prism when stretched taut.)

Securing adjacent bag mouths helps keep the assembly together and prevents spaces from opening between the bag mouths 31 which are to take the place of the slots in the traditional mail case, and also helps maintain sequence order once the strips are removed. It would be unacceptable to have mail insertable between two bags in the multi-bag, so preferably the adjacent margins 32 of each bag are bonded together, continuously or at spaced intervals, along all or substantially all of the perimeter of each bag mouth 31. The reinforcing strips 33 each have a series of pins 34 that penetrate the multi-bag and secure the strip 33. However, the manner in which strips 33 are secured is not critical and any method that facilitates production may be employed, for example, adhesives or chemical or fusion welds.

Figure 3:
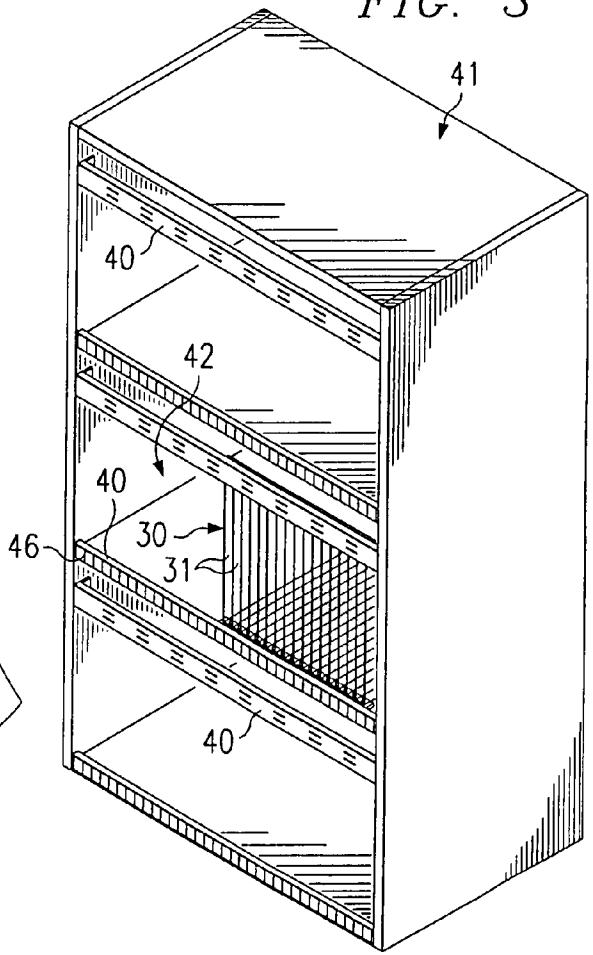
FIG. 3 is a perspective view of the multi-bag storage device of FIG. 2 installed on a rack.

As shown in FIGS. 2 and 3, rounded front edges 36 of each strip 33 may be inserted into grooves in the back of a pair of horizontal rails 40 which are mounted in a postal case 41 according to the invention. When so mounted, bag mouths 31 are held open and the walls of each bag are held substantially taut as shown to make placement of mail into each bag as easy as possible. The walls of each bag are flexible, permitting one bag to accommodate a much greater amount of mail than the fixed width case slots presently in use and without requiring a postal worker to remove or replace partitions to make more room. A second multi-bag device 30 may be placed side by side with the first one in the space 42 shown, and additional devices 30 can also be placed above and below within the case 41.

Bag mouths 31 each correspond to a predetermined destination, and thus it is important for multi-bag 30 to be positioned so that each opening 31 is in the correct position on the case for that address. For this purpose, marks or graduations 46 may be provided along one of the rails 41 so that visual alignment of each bag mouth 31 with its corresponding is maintained. Where sorting is to be carried out manually, indicia of the destination address, such as a label, can be provided in the spaces between marks 46. However, where an automated system is used to sort mail instead of a human being, the label could be omitted or replaced by a machine-scannable label such as a bar code.

Once sorting to individual bags is completed, the entire device 30 may be disconnected from the case and pulled down as a unit. It can then be stored, for example, in a flats tub or letter tray 50 as shown in FIG. 4 or other container, and for this purpose device 30 preferably has dimensions that permit it to fit closely within existing letter trays 50 used by the USPS.

FIGS. 5–8 illustrate a further embodiment of a multi-bag 60 utilizing a frame that presents multi-bag 60 in an upright position so that mouths 62 of bags 63 face upwardly rather than to the side. The frame includes a base 64 and pair of inverted-U shaped rails 66 from which multi-bag 60 hangs by means of a strap 67. Each bag may be torn off along perforations 69 as needed.

FIGS. 9–13 illustrate one form of mail sorting case 70 according to the invention wherein several multi-bag devices 71 are disposed one above another in a case frame 72 which is essentially a cabinet open on one side and provided with horizontal rails 73. As shown in FIGS. 11–12, multi-bag 71 is secured to molded plastic side strips 76 by a series of fasteners 77 such as rivets. Strips 76 have U-shaped flanges 78 that snap into corresponding slots 79 in rails 73, providing a more accessible way of installing and removing each multi-bag device 71.

Figure 14:
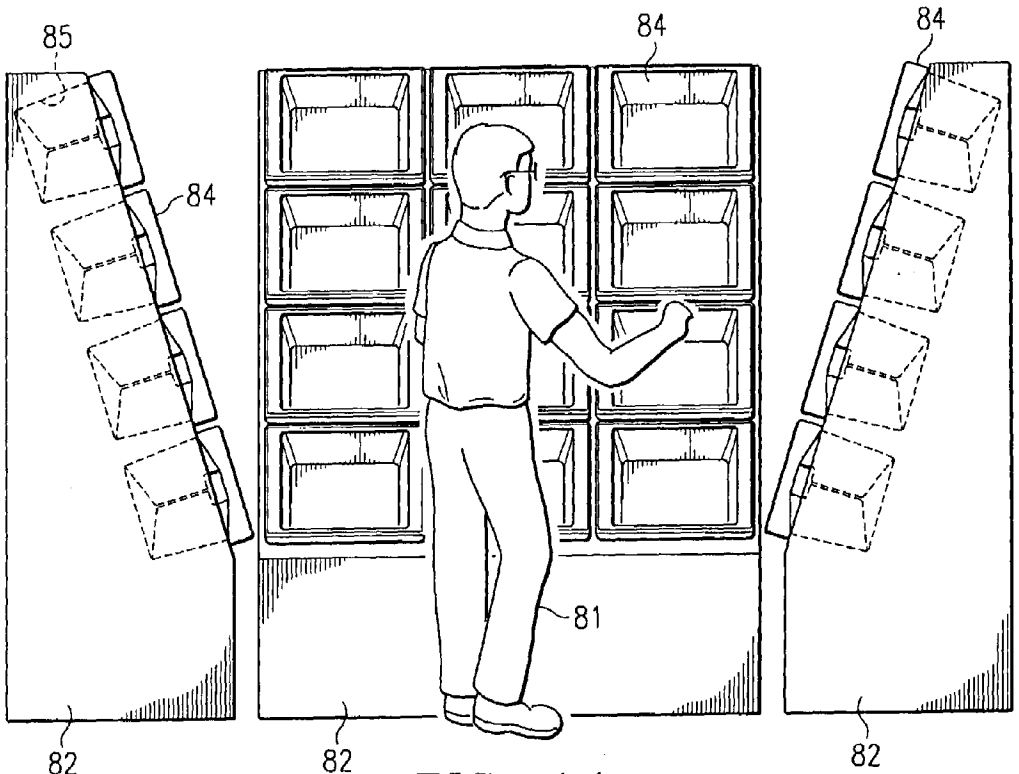
FIG. 14 is a diagram of a 3-sided mail sorting station according to the invention.
Figure 13:
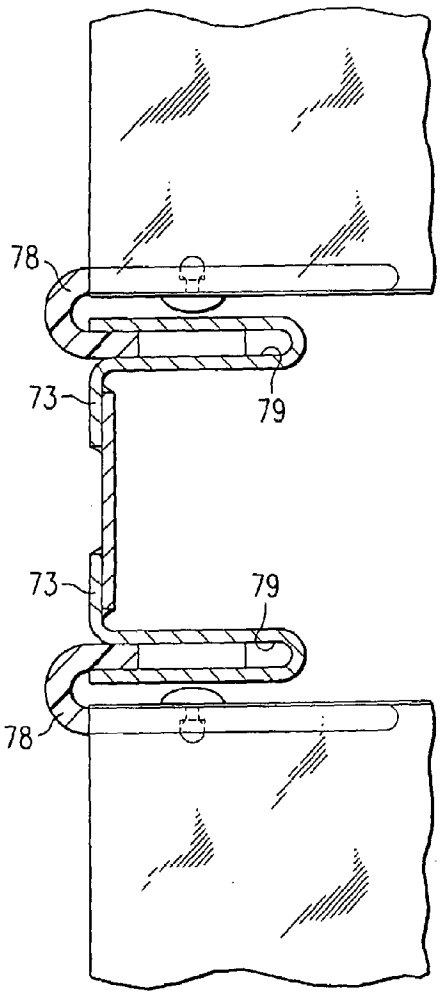
FIG. 13 is a partial side view in section showing two multi-bag devices connected to the case in FIG. 9.

FIG. 14 illustrates a manual sorting station of the invention wherein the operator 81 is surrounded by cases 82 on three sides as shown. Each case presents four rows of flats tubs 84 set in recesses 85 at an angle convenient for sorting. Multi-bags according to the invention are placed into each tub, and then both tub and multi-bag are removed when sorting is completed. This eliminates the separate step of pulling down the multi-bag and placing it in a tub before carrying it away to a delivery truck or the like.

Figure 15:
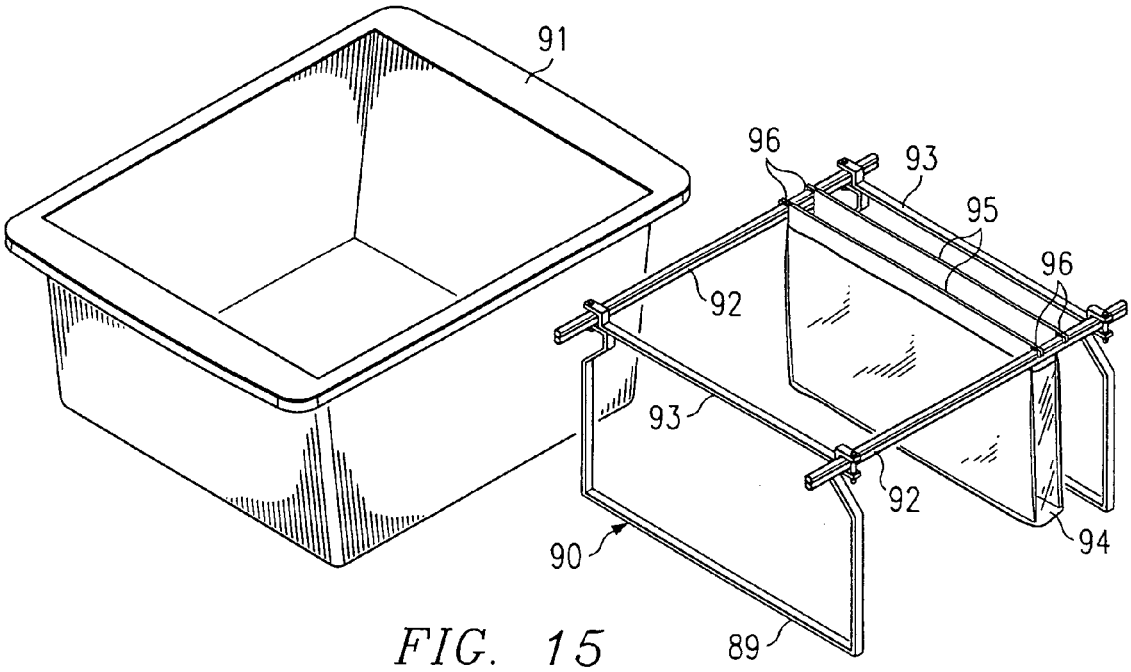
FIGS. 15 and 16 are perspective views of an alternative bag sorting device according to the invention.
Figure 16:
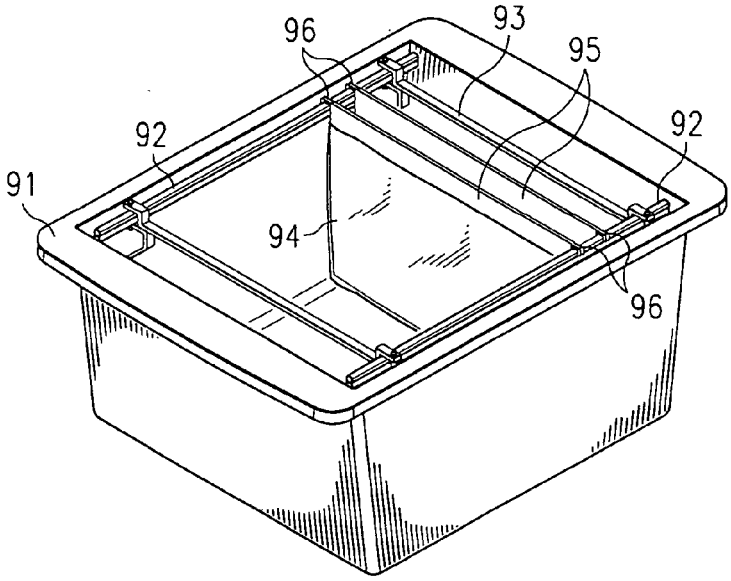
Figure 17:
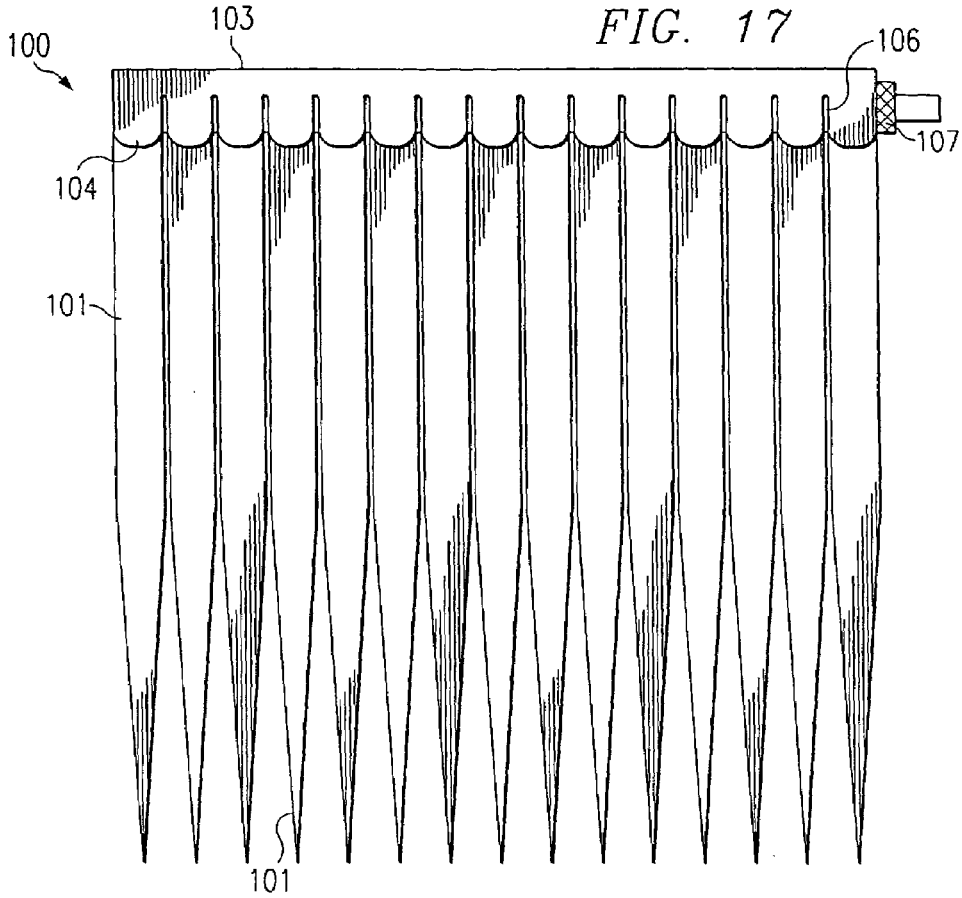
FIG. 17 is a side view of a further embodiment of a multi-bag according to the invention.
Figure 18:
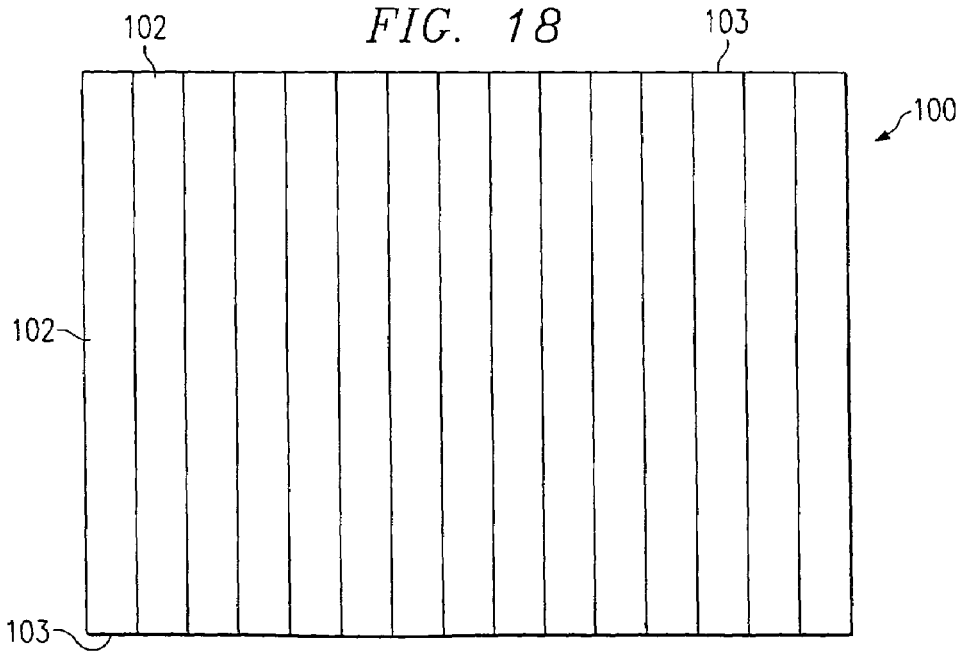
FIG. 18 is a top view of the multi-bag of FIG. 17.
Figure 19:
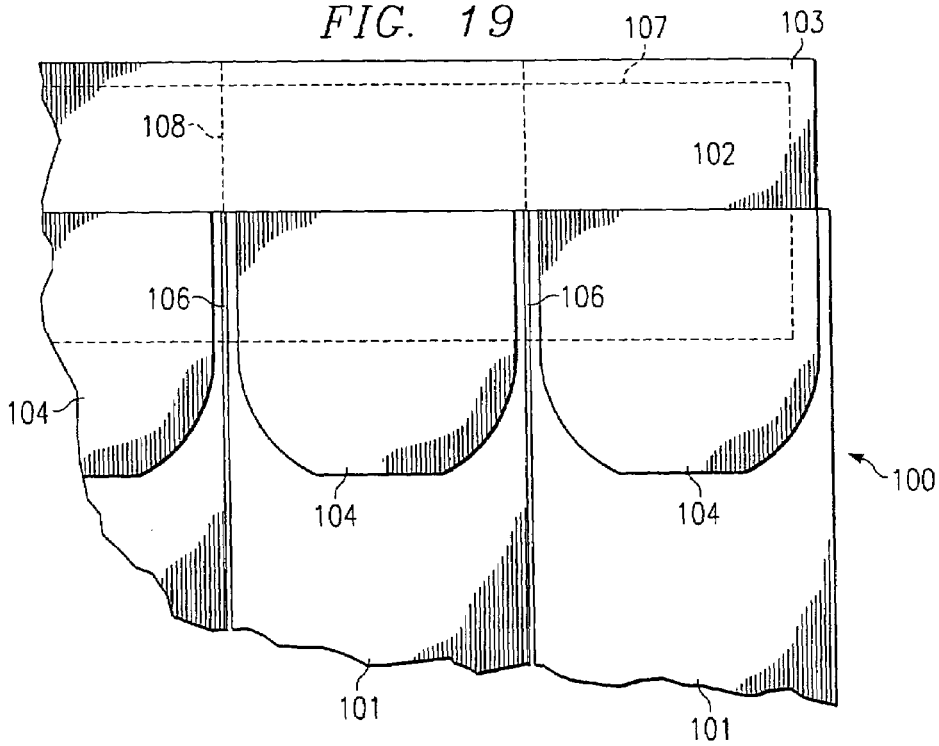
FIG. 19 is an enlarged, partial view of the multi-bag of FIG. 17.
Figure 20:
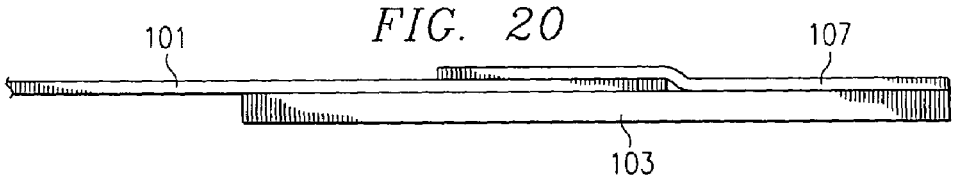
FIG. 20 is a partial side view of the multi-bag of FIG. 19.

FIGS. 15 and 16 show an alternative form of sorting device according to the invention wherein a rectangular frame 90 is sized to fit within a standard size container 91, such as a flats tub. Frame 90 has legs 89 and a pair of side rails 92 and crossbars 93 connecting rails 92 at opposite ends. For each bag 94 to be filled, a pair of dividers 95 hang from rails 92 by hangers 96 (only one pair of dividers is shown, but an entire series of pairs of dividers 95 would be used in practice.) Dividers 95 are preferably inclined toward each other in an inward or downward direction to facilitate insertion of mail. Prior to use, a bag 94 is fitted onto each pair of dividers 95 and the bag top may be folded over as shown like a liner bag in a waste basket. The assembly is then placed in tub 91, and mail is sorted to each bag 94 in the same manner as described above for the multi-bag embodiments. Once sorting is completed, frame 90 may be lifted out of bags 94, leaving bags 94 in tub 91 in the correct order. This system has the advantage that a specially made multi-bag is not required, but lacks the convenience of the multi-bag.

In either type of embodiment, the bags used may be printed with advertising to offset the costs associated with their use. However, if in some instances it is not preferred to deliver mail in a bag to a recipient, a reusable multi-bag may be used wherein the postal carrier removes the mail from the bag at the time of delivery.

Use of the invention by a postal service could be as follows. Each day the carrier sorts the various pieces of mail for his or her route into the mail case(s), as shown in FIG. 14. The combined mail case has three faces, each face having 216 slots, arranged on four shelves, each shelf holding three inserts with 18 bags per insert, these specific numbers being for illustration purposes only. Thus, the mail can be sorted to 648 destinations. At the beginning of the day, the carrier or a mail clerk stretches the multi-bag mail-case inserts over permanent frames in each mail case, snaps it into place, or the like depending on the specific attachment system used. This configuration allows the carrier to pull down several individually packaged stops at a time from the case when the sort operation is completed in preparation for the delivery operation. The individual bags of the multi-bag mail-case inserts are perforated so that they can easily be torn off one at a time and delivered in sequence along the delivery route. By sorting all items in advance into a single bag for each mail stop, the carrier is able to process each stop quickly and efficiently along the delivery route. This results in fewer delivery errors and allows the carrier to handle more stops per route in a given period of time.

A further embodiment of the invention is shown in FIGS. 17–21. Multi-bag 100 of this embodiment includes a series of thin HDPE bags 101. A plastic (polystyrene) strip 103 has a series of tabs 104 separated by spaced notches 106 which penetrate part way through the width of each strip 103. Tabs 104 are sized intentionally to fit into each respective bag mouth 102, and an outer margin of each bag 101 is secured to strip 103 by suitable means, such as an adhesive 107 or weld. Bags 101 are not perforated, but instead can be readily torn away one at a time as needed along a line 108 running from the outer edge of strip 103 to the inner end of each notch 106. In this embodiment, line 108 represents a stress riser or weakest part of strip 103 in the tear-off direction, and does not need to be scored or otherwise weakened. Each strip 103 should have a thickness and width sufficient to keep the bags intact until they are intentionally separate by the carrier.

Bag mouths 102 may be bonded to one another as described above, but it is possible, given the use of a tensioning device in the case as described hereafter, that bonding of adjacent bags can be omitted altogether or reduced to a single central spot of attachment. For this purpose, one of the two adjoining bag surfaces can be formed with a series of bumps that can be used as a material for welding it to the other surface. While direct bonding of one bag to the next is preferred, other forms of attachment are within the scope of the invention. An adhesive could be used to secure adjacent bag mouths together, or a mechanical fastening system can be used wherein both adjoining bag surfaces can be formed with a series of bumps and corresponding recesses that interlock when pressed together.

Figure 21:
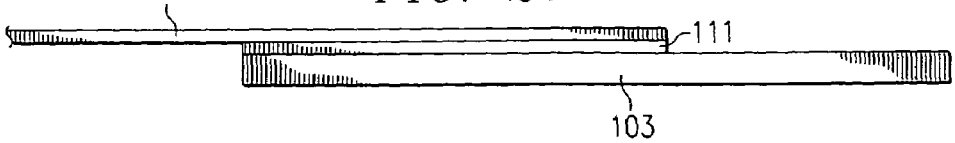
FIG. 21 is a partial side view similar to FIG. 20 showing an alternative binding system according to the invention.
Figure 22:
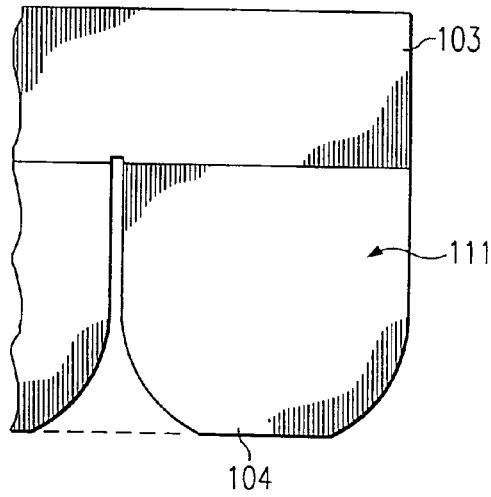
FIG. 22 is an enlarged, partial view of the multi-bag of FIG. 21.

In an alternative embodiment shown in FIGS. 21 and 22, strip 103 is secured to bags 101 by a strip of double-sided adhesive tape 111 which has been applied to tabs 104. Preferably the adhesive side of tape 111 facing strip 103 has greater adhesion than the side facing bags 101, so that bags 101 can be removed from strips 103 at the time of delivery, and the strips 103 with tape 11 attached can be returned for recycling. This, one side of tape 111 is coated with a first adhesive that remains permanently bonded to strip 103, whereas the other side is coated with a second adhesive having a light tack (comparable to re-applyable POST-IT® office notes) so that the plastic bag can be peeled away without damaging it.

In the alternative, tape 111 can be substituted with a single layer of coated-on adhesive that preferentially adheres to strip 103 and has light tack for the plastic, such as polyethylene, that bags 101 are made of. This embodiment eliminates the tape component and hence reduces both the cost and recycling impact of the multi-bag. Other conventional means of attachment without fasteners, such as spot-welding or heat bonding of each tab 104 to each bag 101 at the same location as tape or adhesive layer 111, are also within the scope of the present invention.

During the delivery process, the postal carrier upon reaching a mail stop tears off each individual bag 101 and leaves it in the postal patron's mail box or the like. Depending on how multi-bag 100 is configured, this would require breaking off strips 103 along lines 108 and leaving the two broken-away pieces of strip 103 as part of each bag. In the alternative, the carrier could peel the sides of each bag 101 away from strip 103 and could return strips 103 at the end of the delivery run for recycling or re-use.

The dimensions of multi-bags 30, 60, 100 correspond to the objects being sorted, which could include small products or other items as well as mail pieces. For the latter, the bag mouth is preferably rectangular in its taut state, typically 11.5" long by 1.1" wide, preferably in the ranges of 11–12" long and 1–2" wide. The depth of the bag is not critical but should be deep enough to contain the longest mail piece likely to be encountered with some length to spare. As such a depth of at least 12", preferably 13"–16", is suitable.

Aspects and advantages of the invention include: (1) the removable multi-bag mail case inserts, (2) the mail case with disposable or recyclable bags that consolidate carrier mail for efficient delivery, and (3) a recyclable or disposable plastic multi-bag mail-case insert that is designed to optimize installation, pull-down and delivery time so that overall time savings will more than offset the cost of the insert. The multi-bag inserts provide elasticity whereby extra mail for one or more patrons can frequently be accommodated without having to set aside part of the accumulated mail for that patron before the sort is completed.

The invention further provides a mail sequence-sorting case that is ergonomically superior to existing cases. It facilitates improvements in sorting time as a result of large slots, slot elasticity, use of soft surfaces, elimination of sharp edges, ergonomically acceptable reach distances, reduction of interim pull-down operations as a result of full slots, and easy simultaneous pull-down of multiple slots at the end of the sorting operation. The multi-bag insert may be stretched tightly over a frame to keep the bags open for efficient mail sorting, and the insert is easily and quickly attachable to a case frame, enhancing overall casing productivity. The insert is removed as a single unit in order to minimize pull-down time and enhance overall casing productivity.

The invention further provides a multi-bag mail case insert that maintains sequence order to facilitate delivery efficiency, enhancing overall carrier delivery productivity. The individual bags may be perforated so that they can easily be detached individually for delivery on the carrier route. The use of imprintable bags permits the USPS to recover revenue to offset bag cost or to increase advertising revenue in conjunction with the delivery operation.

Turning now to FIGS. 23–27, an alternative form of multi-bag 300 comprises a plurality of plastic bags 302, each bag preferably being separate from one another for convenience of removal, that are joined together along opposite top sides with two pairs of interlocking male and female plastic strips 304, 306. Each of the strips 304, 306 is from about 0.020 to 0.040 inches thick and is preferably formed from relatively rigid high density plastic, such as high density polyethylene as commonly used in the manufacture of milk cartons or bottles. The thickness of strips 304, 306 will depend upon properties such as tensile strength, tensile set and elasticity of the material used to make the strips, consequently variations in thicknesses of the strips are anticipated. In general, the strip system should be strong enough so that the multi-bag can be handled as a unit, but easy to pull the strips as described hereafter.

Each female strip 306 is about an inch wide and includes a plurality of slots 308, arranged in pairs uniformly spaced along the length of the strip. Slots 308 extend transversely across female strip 306 over a major portion of the width of the strips and may be formed in any conventional manner, such as with a common punch out machine. As illustrated, male strips 304 may be slightly wider, on the order of 1.5 inches wide, and formed along one side with a row of rounded tabs 310 arranged in side-by-side fashion along one edge of the strip. Tabs 310 are separated by notches 312 and each tab 310 is configured to fit into the opening of a bag 302 at an end thereof with the bag material extending into notches 312. Each tab 310 is provided with a pair of centrally located wings 314 having a length approximately equal to the length of slots 308. As in the case of slots 308, wings 314 may be easily formed by punching a pair of opposing "C" shaped sections 316 from the strip at the location of each tab 310. Each "C" shaped section is spaced from the opposing "C" shaped section the same distance as between slots 308 of female strip 306. Each pair of wings 314 is centered on a tab 310 and configured to be inserted in and engage a corresponding pair of slots 308 of female strip 306.

Figure 23:
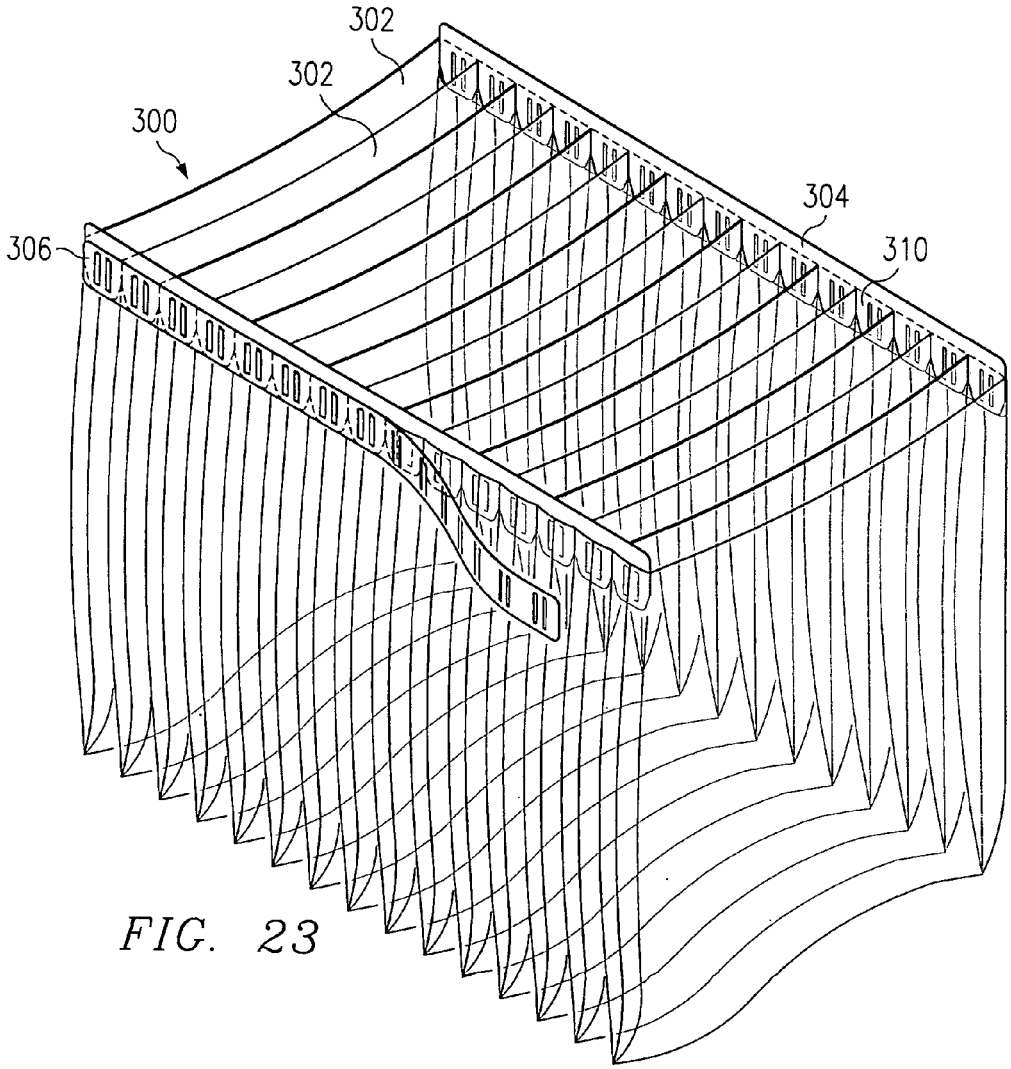
FIG. 23 is a perspective view of an alternative embodiment of a multi-bag according to the invention.
Figure 24:
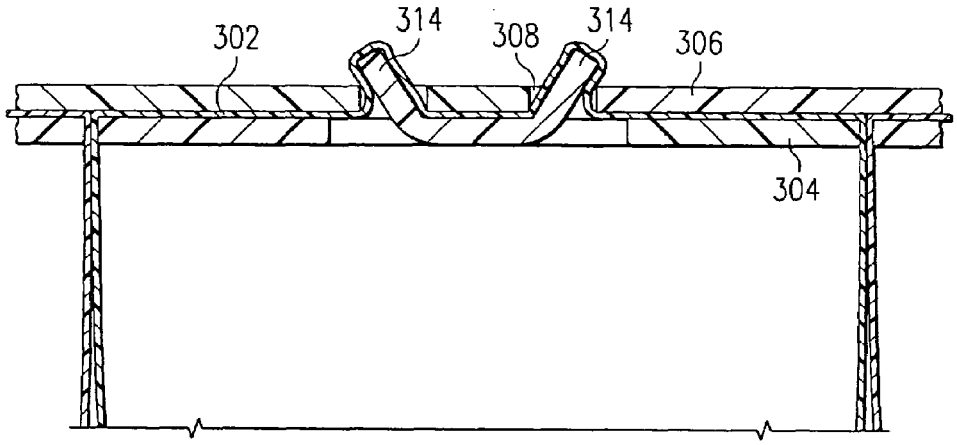
FIG. 24 is a sectional view taken along the line 24—24 in FIG. 23.
Figure 25:
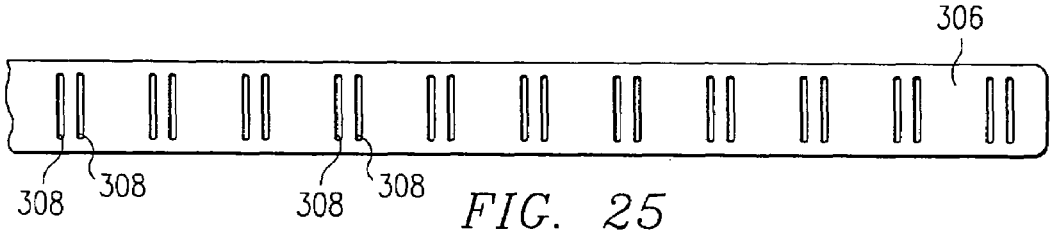
FIG. 25 is a side view of a female strip according to the embodiment of FIG. 23.
Figure 26:
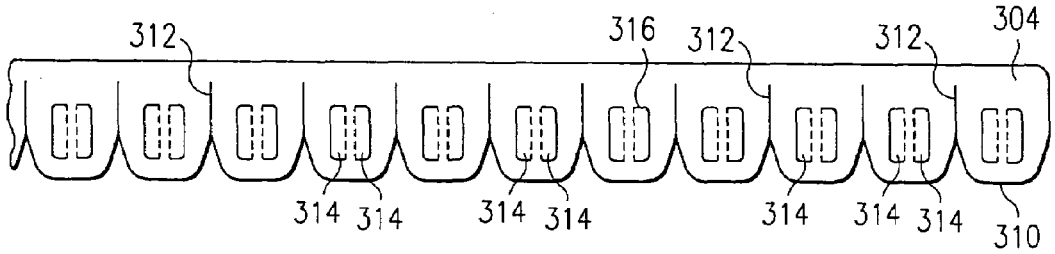
FIG. 26 is a side view of a male strip according to the embodiment of FIG. 23.
Figure 27:
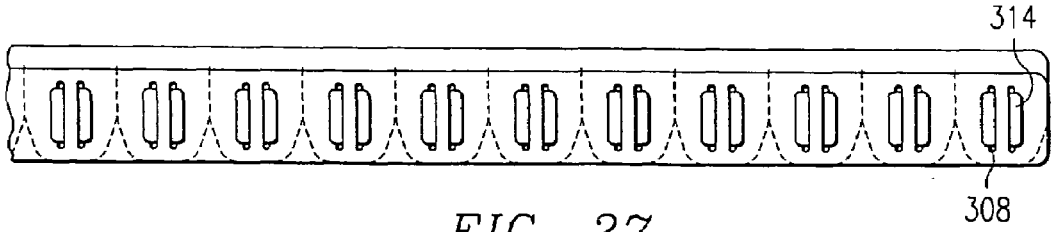
FIG. 27 is a side view of the male and female strips of FIGS. 25 and 26 assembled together.
Figure 28:
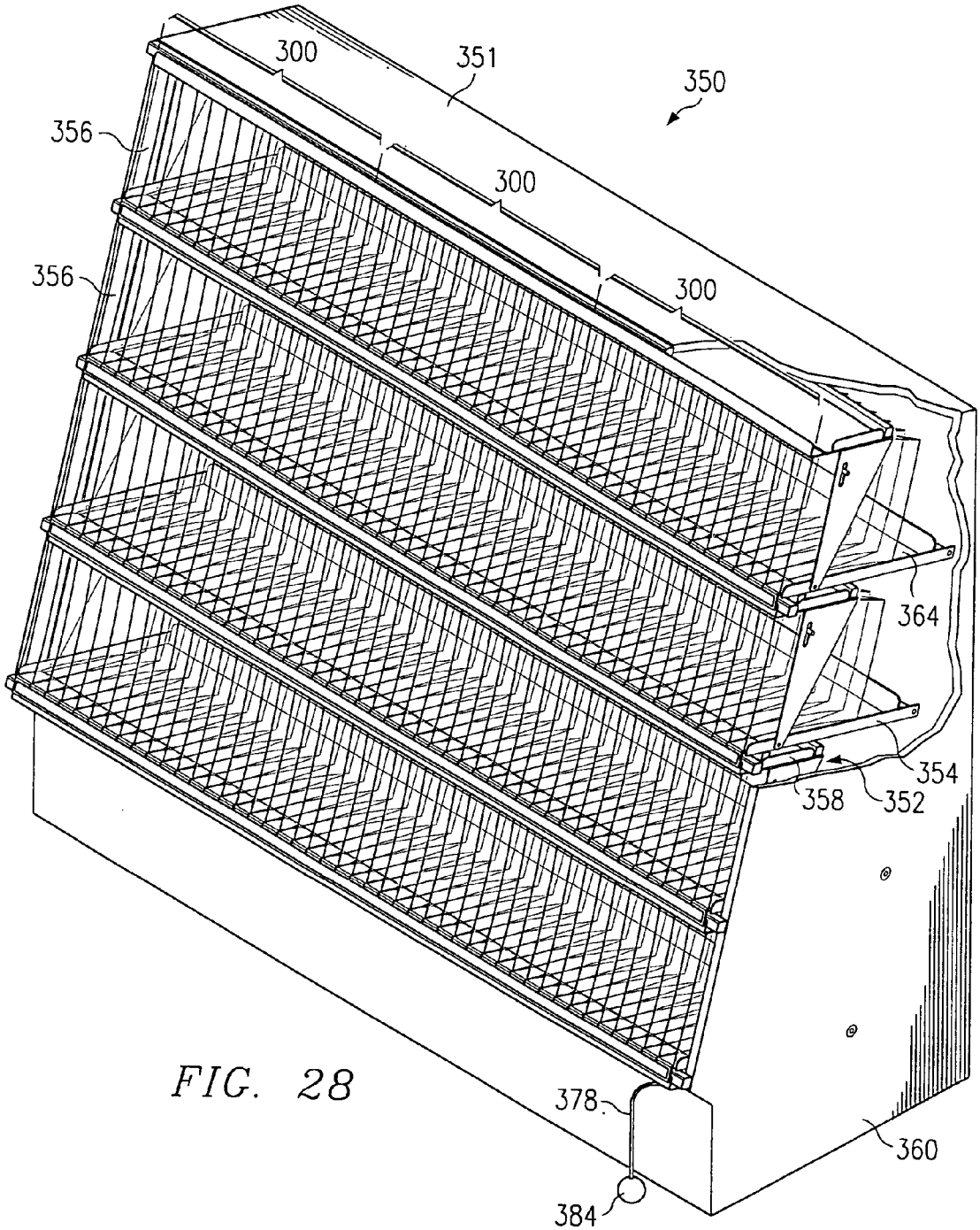
FIG. 28 is a front perspective view, partly broken away, of an alternative case used with the multi-bag of FIGS. 23–27.
Figure 29:
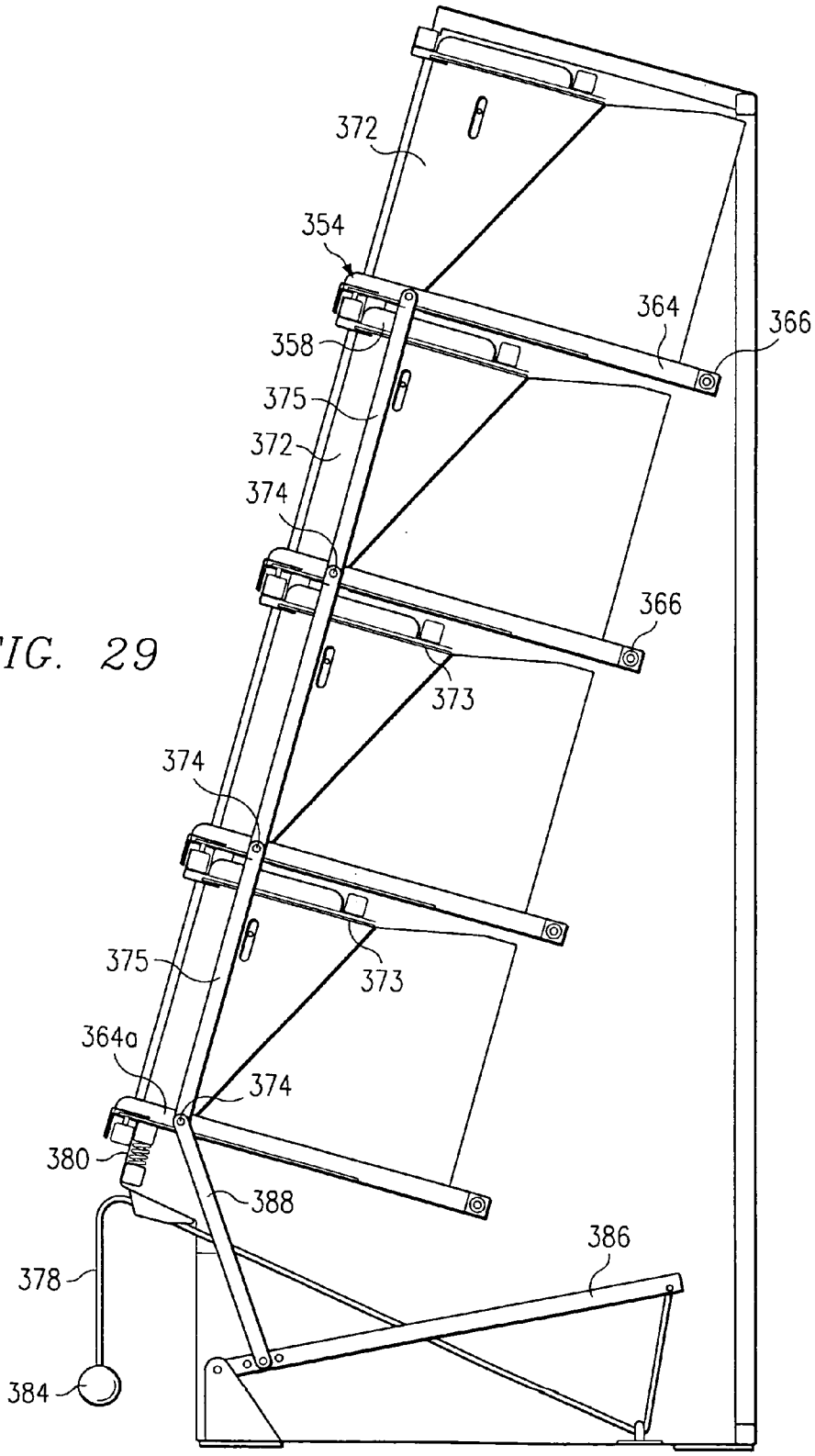
FIG. 29 is a side view, partly broken away, of the case of FIG. 28.

As best shown in FIGS. 23–24, multi-bag 300 is assembled by fitting a plurality of bags 302 over two male strips 304. A tab 310 is inserted into each end 322 of opening 320 of each bag 302 such that the bags are arranged in side-by-side relationship. To complete the assembly of multi-bag 300, a pair of female strips 306 positioned outside the ends of bags 302, parallel to male strips 304 upon which bags 302 have been fitted. Wings 314 are bent outwardly from strip 304 and pressed into and through slots 308 while remaining surrounded by the material of bag 302. After wings 314 have been inserted into slots 308, the wings are released and the inherent resiliency of the plastic material from which strip 304 is formed biases wings 314 against female strip 306, capturing bag 302 between the male and female strips 304, 306. Notably, during this process, bags 302 are not punctured or torn. The flexibility and plasticity of the plastic from which bag 302 is made allows the portion of the bag covering each wing 314 to conform to and follow wing 314 as it is inserted into slot 308 and then released. Once assembled, multi-bag 300 may be deployed for loading in a case.

After multi-bag 300 has been loaded, the filled multi-bag may be disassembled, either at the post office or as the postal carrier goes along his route, depending upon convenience and other factors. Disassembly of multi-bag 300 is accomplished by grasping one pair of ends of strips 304, 306 and pulling the ends in different directions. This pulls wings 314 back through slots 308, "unzipping" the multi-bag. Another advantage provided by multi-bag 300, is that upon disassembly, only the strips remain. No small parts, connectors, staples or other fasteners are generated. Strips 304 and 306 may be reused or recycled and are not delivered to the postal customer.

FIGS. 28–31 illustrate an improved case 350 in accordance with the invention that may be used with an array of multi-bags 300. Case 350 includes a housing 351 having one open side, a generally rectangular stationary frame 352, and a moveable frame 354. Multi-bags 300 stretched onto case 350 as described hereafter present a series of frontwardly facing, vertical, slightly upwardly angled bag openings 356. Stationary frame 352 includes a series of evenly spaced horizontal shelves 358 spanning opposite side walls 360 of frame 352. Movable frame 354 similarly includes a series of movable shelves 364 that rest on shelves 358 when in a lowered position (as shown) and are connected to side walls 360 for pivotal movement by means of hinges 366 at the rear corners of each shelf 364. Each shelf 364 has a pair of upturned side flanges 370 that are each connected to a bottom end of a triangular arm 372 of a holder 373 on either end of the shelf by hinges 374 located near the front of each shelf 364. A series of connecting rods 375 are also pivotally mounted on adjoining hinges 374 as described hereafter.

Figure 30:
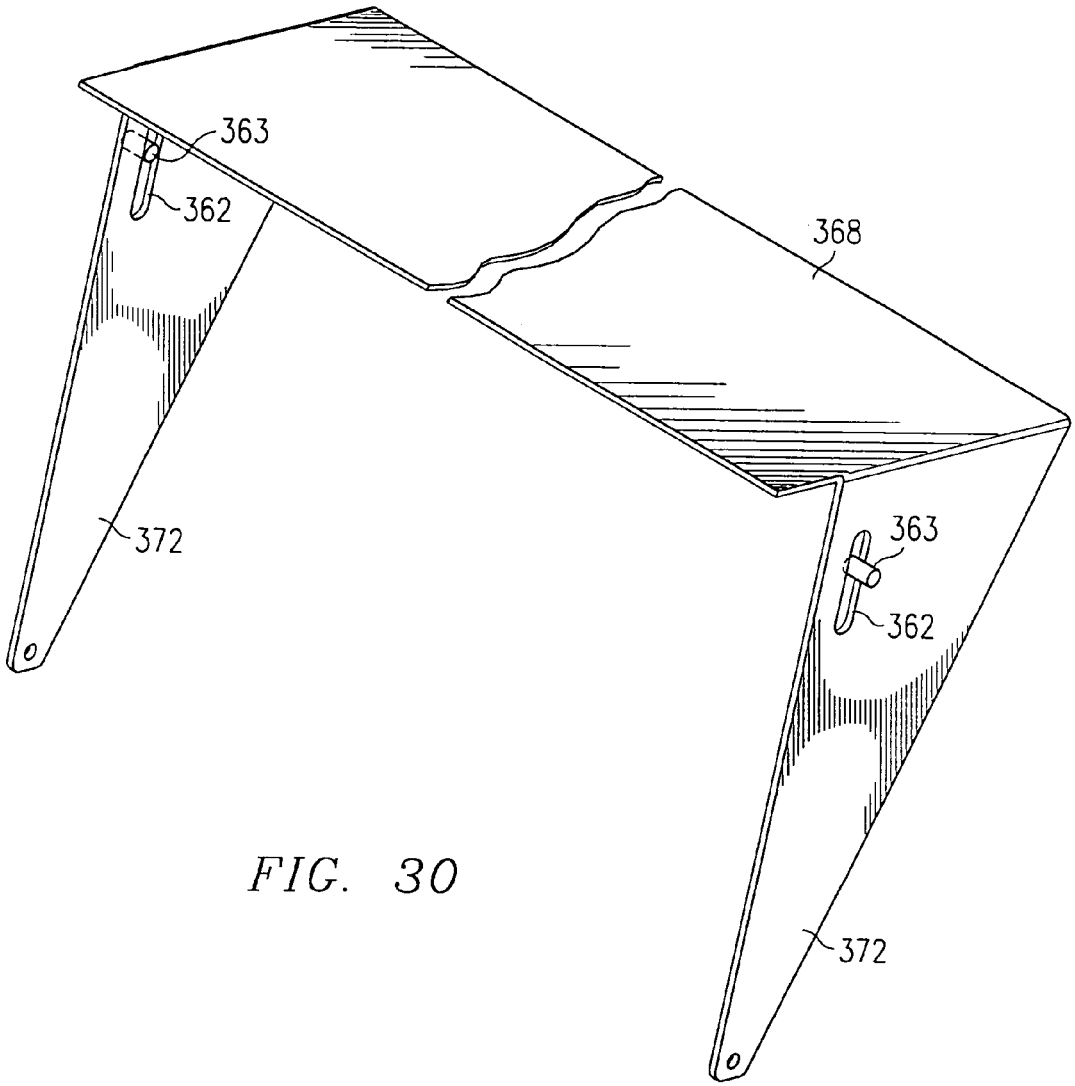
FIG. 30 is an enlarged view of the locking device for the upper ends of the bags shown in FIG. 28.
Figure 31:
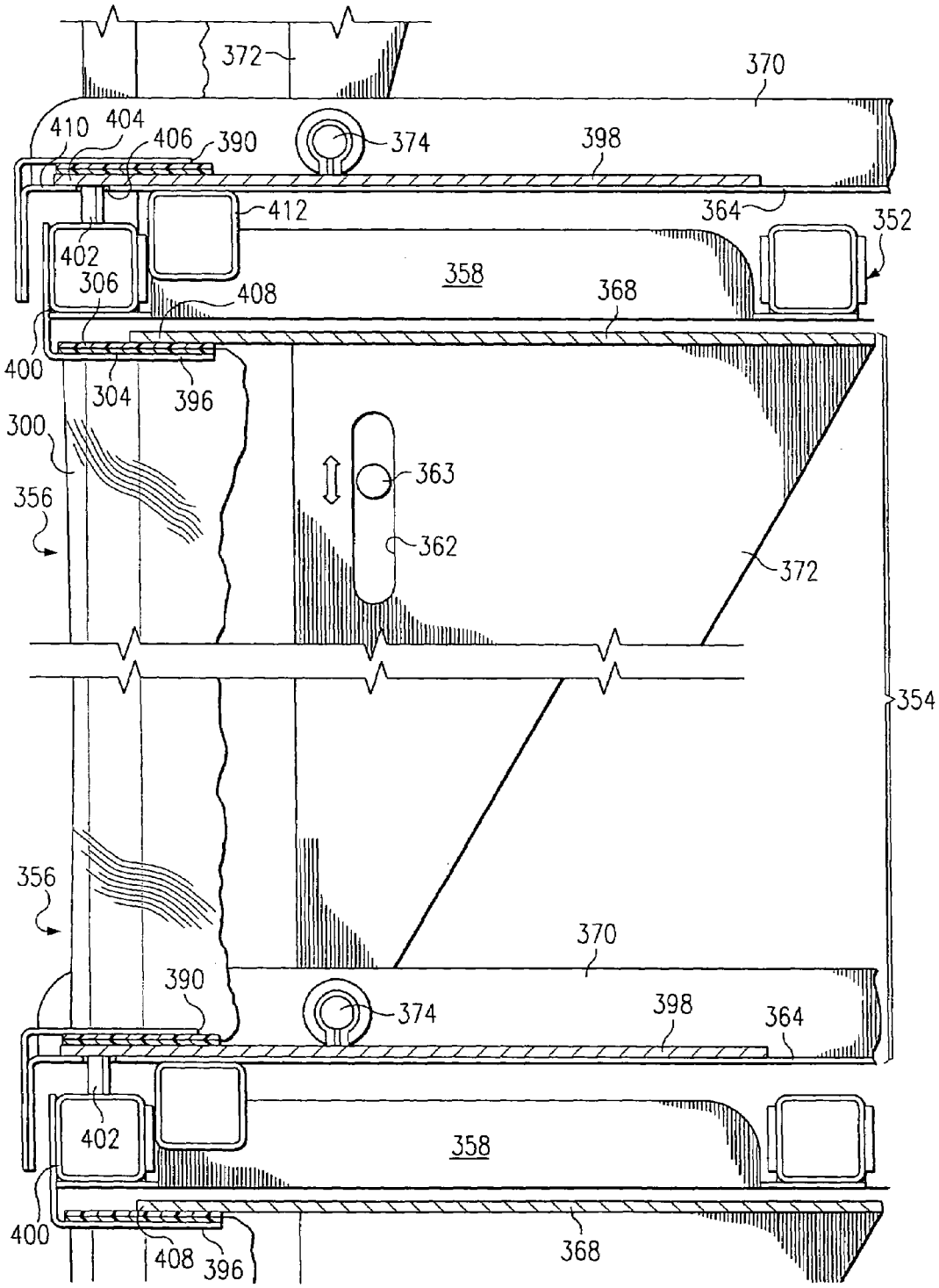
FIG. 31 is an enlarged side view, partly broken away of the movable and stationary shelves shown in FIG. 28.

Each arm 372 comprises a generally triangular flat steel plate that is substantially parallel to and moveable relative to the adjoining side wall 360. As illustrated, each arm is provided with a slot 362 through a bolt 363 mounted on side wall 360 passes. A locking washer (not shown) may be secured on the end of each bolt 363. Slot 362 and bolt 363 cooperate to guide arms 372 over a limited vertical distance relative to stationary frame 352. A substantially horizontal plate 368 spans the top of each pair of arms 372, such that each holder 373 overall has in inverted U-shape as shown in FIG. 30. Each shelf 364 has an inwardly turned, L-shaped flange 390 along its front edge that defines a series of rearwardly-facing tabs and notches similar in shape to those of strip 304, but made of a relatively rigid material such as sheet metal. A transverse reinforcing beam 412 extends along the underside of each shelf 364 and forms part of moveable frame 354.

Stationary frame 352 includes transverse beams 400 extending along the length of each shelf 364 between sidewalls 360. Each beam 400 has one or more upwardly extending pins 402 mounted on a top surface thereof that are aligned with a plurality of corresponding holes 406 in a bottom wall 410 of moveable shelf 364. A free resting flat plate 398 is interposed between shelf 364 and flange 390 along the length of shelf 364, with the forward most edge 404 of plate 398 supported close to pins 402, which engage plate 398 upon downward movement of moveable frame 354. A second notched and tabbed, L-shaped flange 396 depending from stationary beam 400 extends inwardly into bag openings 356 below beam 400 and forms part of stationary frame 352. The forward edge 408 of plate 368 is disposed between beam 400 and flange 396 such that plate 368 is moves towards flange 396 upon downward movement of frame 354.

Case 350 operates as follows. When in a first position in which the movable shelf is positioned upwardly from that shown in FIG. 31, the distance between flanges 390, 396 is slightly less than the width of the multi-bags 300. Bottom shelf 364*a* is supported by a spring loaded stop 380. Stop 380 biases movable frame 354 toward its upper position. Multi-bags 300 may then be manually inserted into case 350 and mounted along opposite sides onto flanges 390, 396 as shown. When the case is fully loaded, the operator then locks the bags 300 into position for sorting by pulling on a handle 384 of a cord 378 or similar device.

Cord 378 is connected to a series of levers 386, 388 which are in turn connected to the lowermost hinge 374. Pulling on cord 378 causes lever 388 to pull down on hinge 374 and hence on bottom shelf 364*a*, moving the entire shelf assembly including holder 373 downwardly. A series of links 375 interconnect hinges 374 of each successive shelf 364, preferably at both ends, so that all shelves 364 move in tandem, pivoting downwardly on hinges 366. This causes flange 390 to move down towards plate 398 and simultaneously causes plate 368 to move down towards notched flange 396, thereby clamping the upper and lower ends of each multi-bag 300 as shown. Strips 304, 306 at the top edge of each bag 300 are thereby captured between plate 368 and tabbed flange 396. Simultaneously, beam 412 moves downwardly, lowering tabbed flange 390 towards plate 398 which is held up by pins 402, trapping strips 304, 306 at the bottom edge of multi-bag 300 between flange 396 and plate 398. The downward movement of movable shelf 364 relative to stationary shelf 352 above it also causes each multi-bag 300 to be stretched into a taught condition suitable for loading mail. Plate 368 in particular acts as a locking mechanism for the upper end of the multi-bag 300, and plate 398 in combination with rods 402 similarly clamps and locks the lower end of the associated multi-bag 300. Cord 378 is secured (e.g., tied off) until the casing operation is completed. Thereafter, cord 378 is released, freeing the movable shelf unit and allowing the mail-filled multi-bags 300 to be disengaged from the flanges and pulled down for further processing.

It will be understood that the foregoing description is of preferred exemplary embodiments of the invention, and that the invention is not limited to the specific forms shown. For example, other means could be used to tension the bags on the case, such as loops on the corners of the multi-bag held on pins, posts or the like on the case. These and other modifications are within the scope of the invention as expressed by the appended claims.

The invention claimed is:

1. A mail delivery system, comprising a series of mail holding devices each comprising a pair of flexible side walls, a bottom uniting the side walls along mutually superposed edges thereof, and an open top, the mail holding devices being disposed side by side such that open tops face a common direction and form a row;

one or more mail pieces placed in each mail holding device;

a container that holds the series of mail holding devices with mail placed therein; and a frame in the container from which the mail holding devices hang in an upwardly opening position.

2. The mail delivery system of claim 1 wherein the mail holding devices comprise bags.

3. The mail delivery system of claim 2 wherein a series of flexible walled bags are disposed side by side in the container such that mouths of the bags face upwardly and form a row.

4. The mail delivery system of claim 1 wherein the container comprises a tub in which the frame and a series of mail holding devices are disposed with the open tops facing upwardly.

5. The mail delivery system of claim 4, the frame further including;

a pair of side rails; and a plurality of pairs of dividers supported by the side rails.

6. The mail delivery system of claim 5 wherein each of the mail holding devices comprise bags positioned between adjacent pairs of the dividers.

7. The mail delivery system of claim 1 wherein the mail holding devices comprise pockets of a multi-bag.

8. The mail delivery system of claim 7, wherein the container comprises a tub in which the multibag is placed so that the pockets of the multi-bag open upwardly.

9. The mail delivery system of claim 1 wherein the mail pieces are disposed in the mail holding devices in an order according to a sortation scheme.

10. The mail delivery system of claim 1 wherein the container has an open top.

* * * * *